US005392553A

United States Patent [19]

Carey

[11] Patent Number: 5,392,553

[45] Date of Patent: Feb. 28, 1995

[54] GUN STOCK ASSEMBLY WITH UNIVERSALLY ADJUSTABLE COMB PIECE

[76] Inventor: Donald C. Carey, P.O. Box 55, Gresham, Or. 97030

[21] Appl. No.: 179,673

[22] Filed: Jan. 11, 1994

[51] Int. Cl.[6] ..... F41C 23/06; F41C 23/14

[52] U.S. Cl. ..... 42/73; 42/74

[58] Field of Search ..... 42/71.01, 73, 74

[56] References Cited

U.S. PATENT DOCUMENTS 1,032,628 7/1912 Sherman ..... 42/73
1,651,299 11/1927 Stansel ..... 42/73
3,710,496 1/1973 Packmayr et al. ..... 42/71.01
4,122,623 10/1978 Stice ..... 42/73
4,589,219 5/1986 Milliman ..... 42/73
4,663,877 5/1987 Bragg ..... 42/74
4,896,446 1/1990 Gregory ..... 42/73
5,031,348 7/1991 Carey ..... 42/74
5,075,995 12/1991 Kennel ..... 42/73

*Primary Examiner*—Stephen C. Bentley
*Attorney, Agent, or Firm*—Eugene D. Farley

[57] ABSTRACT

A shoulder gun stock assembly with a comb piece which is universally adjustable fore and aft, up and down, and laterally, for more comfortable and accurate shooting.

17 Claims, 4 Drawing Sheets

GUN STOCK ASSEMBLY WITH UNIVERSALLY ADJUSTABLE COMB PIECE

This invention relates to shoulder guns which are equipped with recoil-absorbing apparatus. It pertains particularly to recoil-absorbing shotguns.

BACKGROUND AND GENERAL STATEMENT OF THE INVENTION

As is well known, the continued shooting of shotguns and rifles leads to chafing and bruising of the cheek. This is particularly true in trap shooting with shotguns, where several hundred rounds may be fired by a single marksmen in a single day. As a result, the marksmen tends to flinch with each shot, with resultant inaccuracy of marksmanship.

In U.S. Pat. Nos. 4,663,877 and 5,031,348 it has been proposed to associate the substantially stationary firearm shoulder piece of a recoil-absorbing shoulder gun with a stationary comb piece of the shotgun stock assembly. When shooting, the marksman rests his cheek against the comb piece. Since the comb piece remains stationary with the stock, chafing is eliminated.

However, a problem remains. Marksmen have cheek areas of varying proportions and contours. For maximum comfort, and hence for maximum scores, it is important that the comb piece be universally adjustable relative to the stock fore and aft, and laterally and vertically. Otherwise, it is not possible to fit the gun precisely to the needs of the various marksmen who might wish to use it, or of a single owner whose facial contour changes with age.

It accordingly is the general purpose of the present invention to provide a gun stock assembly having a comb piece which is universally adjustable with respect to both elevation and lateral position.

It is a further object of the present invention to provide such a gun stock assembly which is relatively simple in construction, adaptable for use in conjunction with a variety of shoulder guns, and easy to adjust.

It is another object of the invention to provide a gun stock assembly having a comb piece which may be easily and quickly adjusted in the field and on the shooting line without the use of special tools and which, when adjusted, will not "creep" out of adjustment with continued shooting of the gun.

The foregoing and other objects of my invention are achieved by the provision of a gun stock assembly which, broadly considered, comprises a gun stock having a top and a rear portion and in the rear portion a recess opening rearwardly to the exterior, forming a casing. A support block is mounted in the casing.

Recoil-damping, telescopic mounting means mount a recoil block on the support block, rearwardly thereof. A releasable connection, such as a latch, releasably connects the recoil block to the support block.

An angled support bar having first and second segments is arranged to locate the first segment opposite the rear surface of the stock and the second segment over the top thereof. Mounting means mount the first segment of the bar on the recoil block.

A shoulder pad is attached to the first segment of the bar and a comb piece to its second segment.

Vertical adjustment means engage the second segment of the bar for adjusting the vertical position of the bar, and hence of the comb. The adjustment may be made selectively to either the forward or rearward portion of the bar, or to both portions.

Lateral adjustment means engage the bar for shifting it to the desired degree laterally to the right or left. This, too, may be accomplished selectively with respect to the forward and rearward portions of the bar, and hence of the comb. Alternatively, the entire comb may be shifted as desired to the right to left.

In this manner, the desired universal adjustment of the comb relative to the stock may be obtained.

THE DRAWINGS

Figure 2:
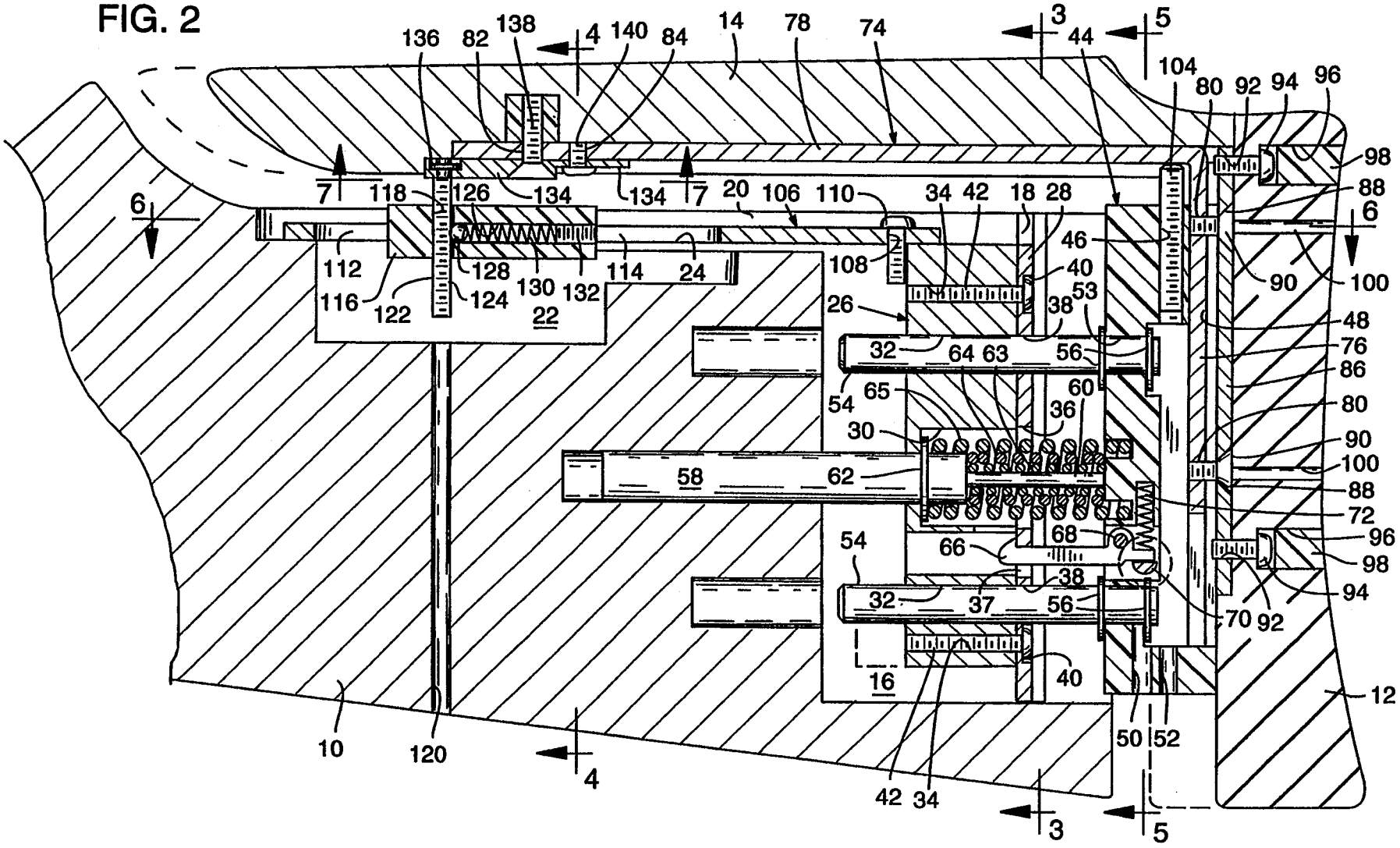
FIG. 2 is a longitudinal sectional view of the assembly.
Figure 3:
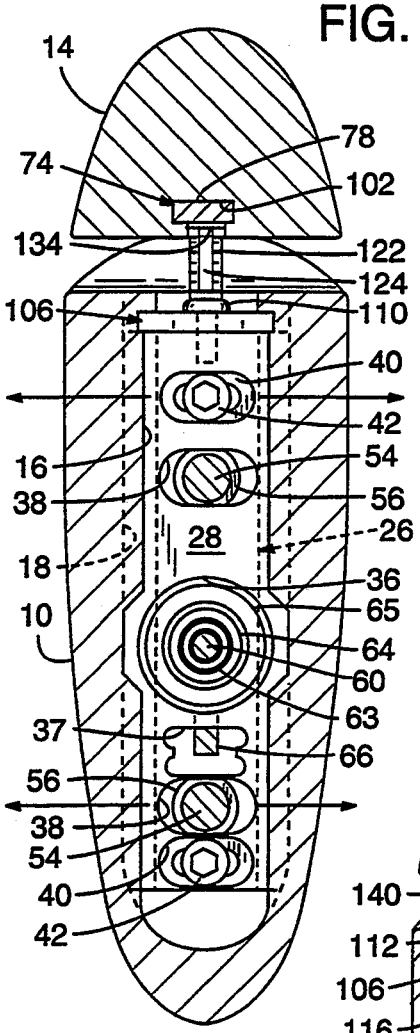
Figure 4:
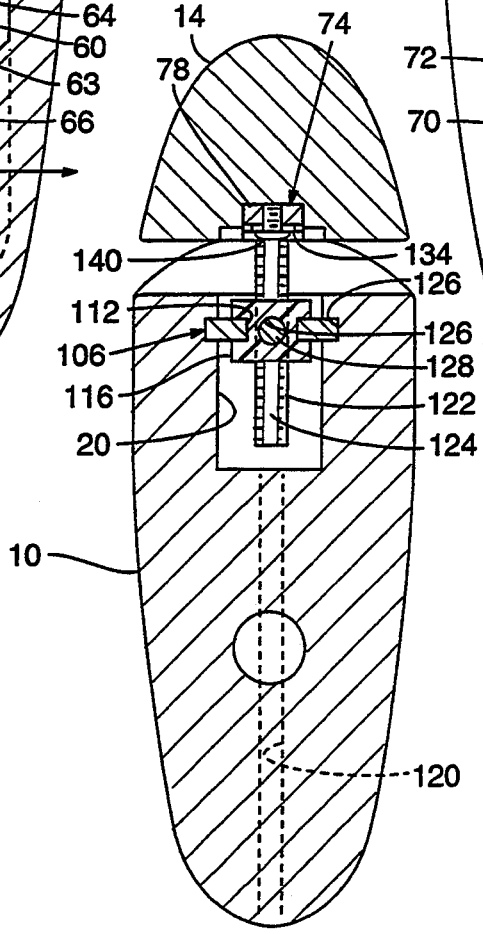
Figure 5:
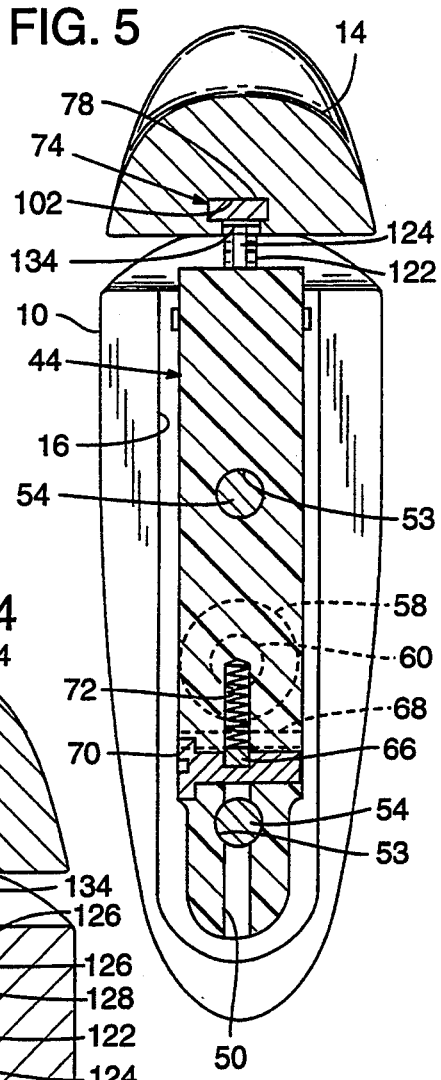

FIGS. 3, 4 and 5 are transverse sectional views taken along lines 3, 4 and 5, respectively, of FIG. 2.

Figure 7:
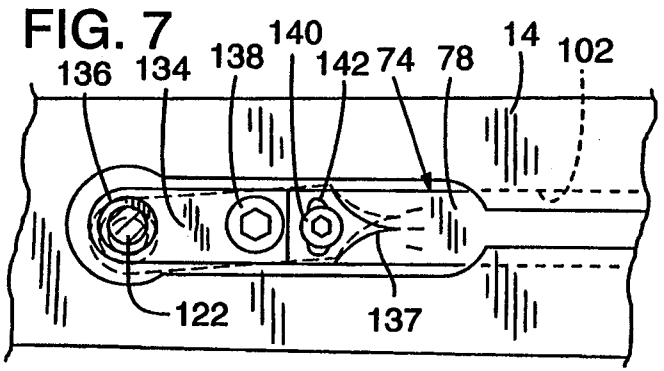
Figure 6:
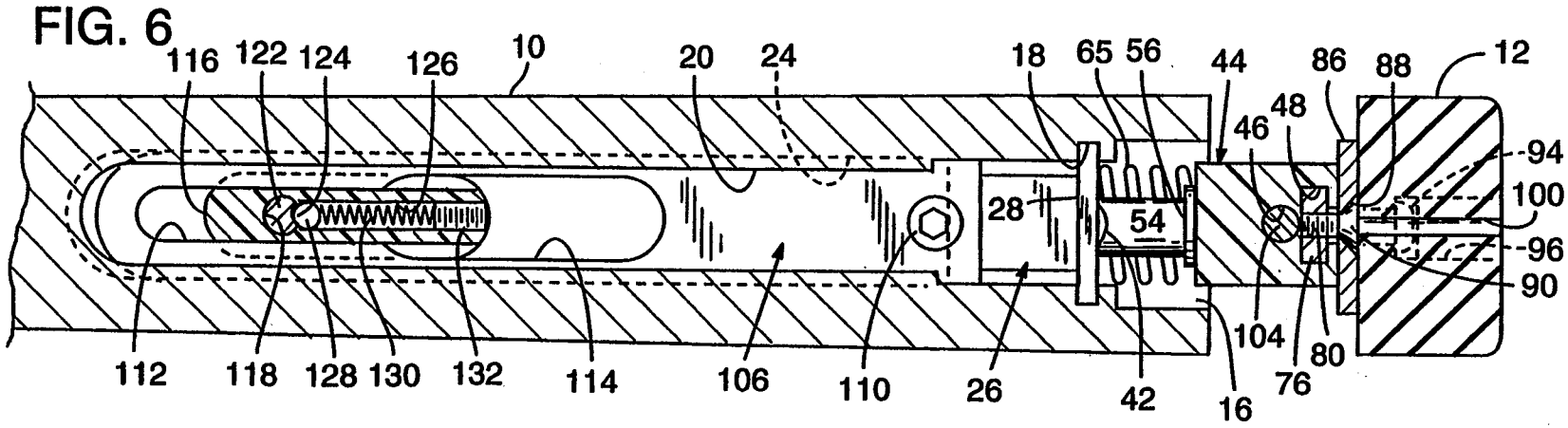

FIGS. 6 and 7 are longitudinal views of the assembly, taken along lines 6—6 and 7—7, respectively.

Figure 8:
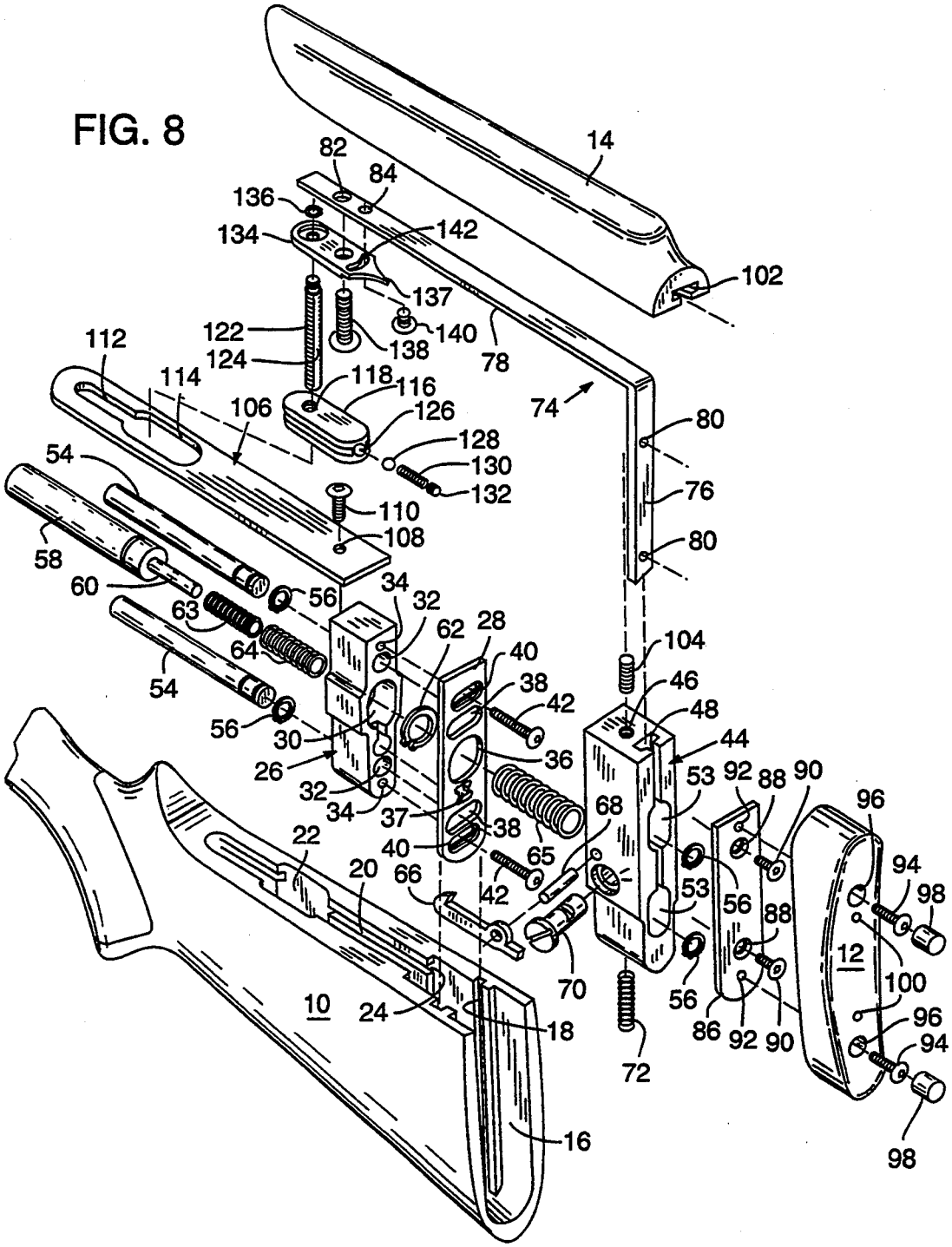

FIG. 8 is a fragmentary, exploded, top perspective view showing the components of the assembly in the order of their arrangement within and on the stock.

DESCRIPTION OF A PREFERRED EMBODIMENT OF THE INVENTION

In the description below, it is assumed that the gun is in its operative position, supported by the marksman and abutted against his shoulder. With reference to this position, the terms "forwardly", "rearwardly", "above", "below", etc. are used to indicate relative positions and not in a limiting sense.

Figure 1:
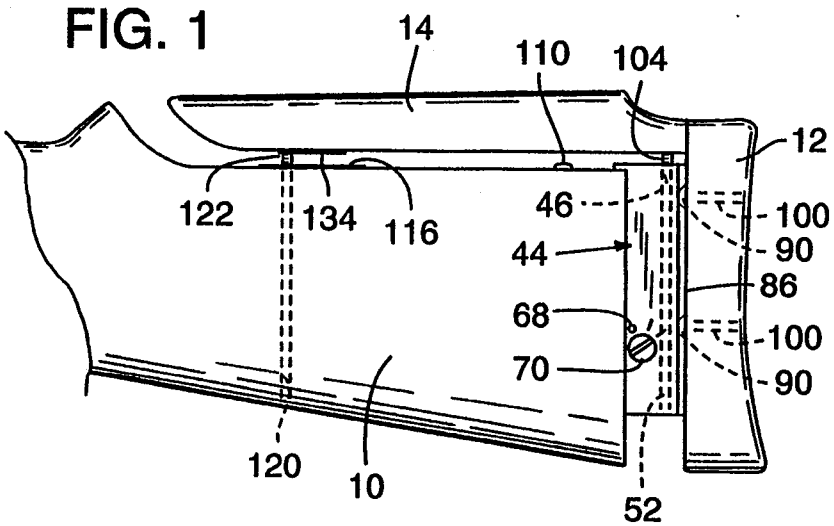
FIG. 1 is a fragmentary view in elevation of the gun stock assembly of the invention illustrating the principal components of the assembly in their assembled relation to each other.

Referring to FIG. 1, the gun stock assembly of my invention includes a stock 10, a recoil-absorbing shoulder pad 12, and a comb or cheek rest 14.

In preparation, the upper part of the original gun stock is cut longitudinally to separate comb 14. Also, the rear portion of the stock is cut to length and hollowed out to form a recess 16 opening rearwardly to the exterior, forming a casing. The recess is milled to form a vertical way 18, a longitudinal extension 20 having an enlarged portion 22, and a longitudinal keyway 24, FIGS. 2 and 8.

A support block ("offset block") assembly is housed in recess 16. It comprises a support block 26 and an associated, laterally slotted adjusting plate 28.

Support block 26 is laterally shiftable and has a central bore 30 of substantial size. Bore 30 separates a pair of guideways 32. Threaded openings 34 span the guideways.

Adjusting plate 28 is dimensioned and contoured to seat removably in keyway 18. It is provided with a central opening 36 which substantially registers with central bore 30 of support block 26. It also is provided with a pair of laterally extending slotted openings 38 which are opposed to guideways 32 in support block 26.

A second pair of slotted openings 40 substantially registers with threaded openings 34 in the support block. Set screws 42 penetrate slotted openings 40 and are threaded into threaded openings 34. They afford a means of securing lateral adjustment of support block 26 relative to plate 28, as will appear hereinafter.

A recoil block assembly is telescopically supported by support block 26.

Recoil block 44 is fabricated of suitable millable, hard material such as hard plastic or hard rubber. It is dimensioned to seat in part in recess 16 of gun stock 10.

The recoil block is milled to provide an upper, longitudinal, threaded opening 46, a substantially parallel slotted guideway 48 and, in its lower portion, a longitudinal bore 50 and a substantially parallel access passageway 52, FIG. 2.

The recoil block is supported on a pair of posts 54. These are arranged with their rear terminal portions retained in spaced transverse openings 53 through recoil block 44 they are retained by snap rings 56. The forward portions of posts 54 are received slidably in guideways 32 of support block 26.

The recoil damping subassembly associated with recoil block 44 comprises a conventional hydraulic damping cylinder 58 having a piston rod 60.

The forward end of the cylinder is retained in central bore 30 of support block 26 by means of a snap ring 62. Its piston rod 60 mounts a trio of nesting coil springs 63, 64, 65. These are arranged to reinforce the damping action of the cylinder. This is accomplished in the manner illustrated particularly in FIG. 2, by arranging the springs and piston rod 60 in bearing engagement against the face of recoil block 44.

Recoil block 44 accordingly can shift positions between the full and dotted line positions of FIG. 2, but against the force of the recoil damping subassembly. This tension relationship is maintained by means of a connecting subassembly including a latch or striker 66 supported for oscillatory movement on pin 68.

Latch 66 is spring pressed by a coil spring 72 housed in bore 50 of recoil block 44. It is operated by means of a cam 70 having a slotted head accessible to the exterior, as is shown particularly in FIGS. 5 and 8.

The latching element or detent of latch 66 is contoured and dimensioned to enter latch opening 37 of adjusting plate 28, which acts as a keeper.

Accordingly, by moving the recoil block forwardly against the force of the recoil damping assembly, latch 66 can be caused to enter opening 37 in the adjusting plate. Thereupon spring 72 forces the latch upwardly into engagement with the plate, holding the recoil block in the desired spatial relationship to the support block and under the condition of tension required for operation of the recoil damping assembly.

The recoil assembly thus described mounts both shoulder pad 12 and comb 14, which move as a single unit independently of stock 10. This is accomplished by providing an angled support bar 74 arranged to have a first segment 76 overlying the rear portion of the gunstock and a second segment 78 overlying the top thereof.

As is apparent particularly in FIG. 8, the first named or vertical segment of bar 74 has a pair of spaced, threaded openings 80. These provide means for affixing releasably a shoulder pad assembly comprising shoulder pad 12 and shoulder pad support plate 86.

The outer end of support bar segment 78 is provided with a pair of threaded openings 82, 84.

Support plate 86 is designed for insertion between shoulder pad 12 and recoil block 44. It is provided with a pair of spaced openings 88 dimensioned to receive screws 90 by means of which the plate may be affixed to segment 76 of support bar 74 by being threaded into openings 80 of the latter.

Shoulder pad support plate 86 also has spaced, marginal, threaded openings 92 by means of which shoulder pad 12 may be releasably fastened to the support plate, and hence indirectly to support bar 74. Screws 94 penetrate openings 96 and are backed up and concealed by filler plugs 98.

Access holes 100 afford access for working screws 90 which engage openings 80 in support bar 78, thereby mounting the shoulder pad assembly removably on the support bar.

Attaching means also are provided for releasably attaching comb 14 to the support bar. As is apparent from FIGS. 2 and 8, the comb is provided with a T-shaped (in cross section) guideway or slot 102 dimensioned to receive segment 78 of support bar 74 in sliding engagement.

Both shoulder pad and comb thus are mounted on support bar 74 and move as a single unit. This arrangement makes possible universal adjustment of the comb relative to the stock: up, down and sideways; selectively fore or aft, and together fore and aft.

To achieve this purpose, recoil block 44 has a longitudinally extending passageway 52 which communicates and is aligned with threaded passageway 46. An Allen head jackscrew 104 works in the threaded passageway. Its outer end works in T-shaped guideway slot 102 in comb 14. It bears against the underside of the rear portion of support bar segment 78. After loosening screws 90, elevating jackscrew 104 elevates the rear portion of the support bar, and hence of comb 14, to the desired elevation. Lowering the screw makes it possible to lower the comb by application of light hand pressure to the upper surface of the comb.

Lateral adjustment of the rear portion of comb 14 is achieved by the simple process of unlatching latch 66 and removing the support bar 74 assembly including the comb. Loosen set screws 42 and adjust the position of support block 26 relative to adjustment plate 28, as indicated by the arrows of FIG. 3. This adjustment correspondingly adjusts the lateral position of recoil block 44, and hence of the support bar 74 assembly including the comb.

Vertical and lateral adjustment of the forward portion of comb 14 is obtained by means of an assembly the construction and manner of operation of which are illustrated in FIGS. 2, 6, 7 and 8.

Slidably mounted in keyway 24 in stock 10 is a plate 106, termed herein the "comb plate". In its rearward end, the comb plate has a threaded opening 108 designed for reception of a stop or locating screw 110. Stop screw 110 is designed to abut the forward face of support block 26, thereby locating the comb plate in the keyway.

A longitudinally extending slot 112 having an enlarged rearward portion 114 is cut into the forward end of comb plate 106. It is designed to overlie the enlarged recess 22 of stock 10.

A slide block 116 is mounted for sliding movement in slot 112. It is so dimensioned as to be separable from comb plate 106 via the enlarged portion 114 of the guide slot, as is particularly evident in FIG. 8.

A threaded passageway 118 through the slide block registers with an access passageway 120 through the stock, FIG. 2. An Allen head adjustment screw (jackscrew) 122 works in threaded passageway 118.

Detent means releasably lock adjustment screw 122 in a selected position of vertical adjustment. To this end, the screw has a groove 124 which can be made to register with a longitudinal passageway 126 through the slide block, FIG. 2. The detent passageway receives a detent ball 128 which is pressed by spring 130 and secured in the passageway by setscrew 132.

Adjustment screw 122 raises and lowers a link 134 (termed herein a "caster") to which it is attached in swivelling relation by means of a retaining ring 136.

Caster 134, has a pointer 137 and an arcuate, calibrated slot 142. It is attached adjustably to the forward end 78 of the support bar by means of a pivot screw 138, which works in threaded opening 82, and a locking screw 140, which penetrates arcuate slot 142 and works in threaded opening 84.

As noted, the foregoing assembly makes possible universal adjustment of the front end of comb 14. The front end may be raised or lowered by raising or lowering adjustment screw 122. If segment 78 of support bar 74 is of flexible material, as it may be, the adjustment may be made by flexing the bar without releasing segment 76 thereof.

Cast adjustment of the forward end of comb 14 may be made by separating the support bar-shoulder pad-comb assembly from the stock, and loosening both pivot screw 138 and lock screw 140.

Caster 134 then is moved angularly to the desired setting, as indicated in dashed outline on the associated calibration, indicated in FIG. 7. The two screws then are tightened down and the gun stock reassembled.

OPERATION

To summarize the manner of adjusting the position of the comb both vertically and laterally:

To adjust the front of the comb for elevation, insert an Allen head wrench in access passageway 120 until it engages adjustment screw 122. Working this screw raises or lowers the forward portion of flexible support bar segment 78 together with the comb which it supports.

To adjust the rearward end of the comb, release set screws 90. Insert an Allen head wrench in access opening 52, and work adjustment screw 104. Elevating the screw raises the comb. Lowering the screw, followed by applying slight pressure to the comb, lowers the comb.

To cast the front of the comb, unlock latch 66 by means of cam 70, separate the parts, loosen pivot screw 138 and lock screw 140, reset link 134 as indicated on the calibration, and tighten screws 138, 140.

To cast the rear portion of the comb, loosen set screws 42, move the comb right or left, and retighten.

When shooting the gun with the comb in its adjusted position, recoil pad 12 is held firmly on the shoulder. The cheek rests lightly on comb 14. When the gun is fired, the gun barrel moves rearwardly. The shock is absorbed by cylinder 58 and springs 63–65. The shoulder pad and comb remain almost stationary, resulting in less recoil, more comfortable shooting, and better scores.

Having thus described in detail a preferred embodiment of the present invention, it will be apparent to those skilled in the art that many physical changes may be made without altering the inventive concepts and principles embodied therein. The present embodiment is therefore to be considered in all respects as illustrative and not restrictive, the scope of the invention being indicated by the appended claims.

I claim:

1. A gun stock assembly comprising:

a) a gun stock having top, forward and rear portions and in the rear portion a recess opening rearwardly to the exterior, forming a casing, b) support block means mounted in the casing, c) recoil block means, d) recoil-damping, telescopic mounting means mounting the recoil block means on the support block means, rearwardly thereof, e) connecting means releasably connecting the recoil block means to the support block means, f) angled bar means 74 having first and second segments disposed with the first segment overlying the rear portion of the stock and the second segment overlying the top thereof, g) mounting means releasably mounting the first segment on the recoil block means, h) a shoulder pad, i) first attaching means releasably attaching the shoulder pad to the first segment of the bar means, j) a comb having forward and rearward portions, k) second attaching means releasably attaching the comb to the said second segment of the bar means.

2. The gun stock assembly of claim 1 wherein the connecting means comprises latch means 66.

3. The gun stock assembly of claim 1 wherein the connecting means comprises cam 76 operated 70 latch means.

4. The gun stock assembly of claim 1 wherein the mounting means mounting the first segment of the bar means comprises a keyway 48.

5. The gun stock assembly of claim 1 including first comb elevation-adjusting means engaging the second segment of the angled bar means adjacent the forward portion of the comb, and mounting means mounting the comb adjusting means in the forward portion of the stock.

6. The gun stock assembly of claim 5 wherein the first comb adjusting means comprises jack screw 122.

7. The gun stock assembly of claim 6 including jack screw detent means working on the jack screw means.

8. The gun stock assembly of claim 6 including detent means comprising spring pressed detent ball means 128.

9. The gun stock assembly of claim 1 including cast adjustment means engaging the said second segment of the bar means adjacent the forward portion of the comb, and mounting means for mounting the same in the stock.

10. The gun stock assembly of claim 9 wherein the cast adjusting means comprises pivotally mounted caster 134 and locking means 140 locking it in a selected position of adjustment.

11. The gun stock assembly of claim 1 including an elevation and cast adjustment subassembly for adjusting the elevation and cast of the forward portion of the comb, the subassembly comprising a comb plate 106, a longitudinal slot 112 in the comb plate, means for mounting the comb plate in the top portion of the gun stock, a slide block 116 working in the slot, a jack screw 122 threaded into the slide block, a caster 134 connected to the jack screw and pivotally mounted to the end of the second segment 78 of support bar 74, and a locking screw 140 positioned for releasably locking the caster in a selected position of adjustment.

12. The gun stock assembly of claim 1 including adjustable elevation means for the rear portion of the comb.

13. The gun stock assembly of claim 12 wherein the elevation means comprises jack screw 104.

14. The gun stock assembly of claim 13 including guide 48 and slide 76, means for mounting the angled bar means 78, and-wherein the jack screw means comprises jack screw 104.

15. The gun stock assembly of claim 1 including cast adjustment means mounted in the stock and operative to cast the rearward portion of the comb.

16. The gun stock assembly of claim 15 wherein the cast adjustment comprises an adjusting plate 28 and set screw mounting means 34, 42 for adjustably mounting the adjusting plate to the support block 26.

17. The gun stock assembly of claim 16 wherein the telescopic mounting means mounting the recoil block means on the support block means includes a pair of support posts 54 fixed to the recoil block means and slidably mounted in the support block means.

* * * * *